US012674634B2

(12) United States Patent
Wu et al.

(10) Patent No.: US 12,674,634 B2
(45) Date of Patent: Jul. 7, 2026

(54) MULTI-DIRECTIONAL JET CLEANING APPARATUS FOR STEAM GENERATOR

(71) Applicants: SUZHOU NUCLEAR POWER RESEARCH INSTITUTE CO., LTD., Suzhou (CN); CHINA GENERAL NUCLEAR POWER GROUP, Shenzhen (CN); CGN POWER CO., LTD., Shenzhen (CN)

(72) Inventors: Weirang Wu, Suzhou (CN); Tong Yu, Suzhou (CN); Chun Ye, Suzhou (CN); Zhifeng Cheng, Suzhou (CN); Xunzong Yang, Suzhou (CN)

(73) Assignees: SUZHOU NUCLEAR POWER RESEARCH INSTITUTE CO., LTD., Suzhou (CN); CHINA GENERAL NUCLEAR POWER GROUP, Shenzhen (CN); CGN POWER CO., LTD., Shenzhen (CN)

( * ) Notice: Subject to any disclaimer, the term of this patent is extended or adjusted under 35 U.S.C. 154(b) by 271 days.

(21) Appl. No.: 18/697,016

(22) PCT Filed: Sep. 29, 2021

(86) PCT No.: PCT/CN2021/121734

§ 371 (c)(1),
(2) Date: Mar. 29, 2024

(87) PCT Pub. No.: WO2023/050161

PCT Pub. Date: Apr. 6, 2023

(65) Prior Publication Data

US 2026/0132998 A1 May 14, 2026

(51) Int. Cl.
*F28G 3/16* (2006.01)

(52) U.S. Cl.
CPC ..... *F28G 3/163* (2013.01)

(58) Field of Classification Search
CPC ..... F28G 1/16; B05B 15/68; B05B 9/0426; B05B 13/0636; B05B 13/0421; B08B 3/02; B08B 9/0936
See application file for complete search history.

(56) References Cited

U.S. PATENT DOCUMENTS 4,989,785 A * 2/1991 Walendowski ..... B05B 13/0421 239/263.3
5,715,852 A * 2/1998 Jepsen ..... B08B 9/0936 134/167 R (Continued)

*Primary Examiner* — Joseph A Greenlund
(74) *Attorney, Agent, or Firm* — Andrew C. Cheng

(57) ABSTRACT

Disclosed is a multi-directional jet cleaning apparatus for a steam generator, comprising a frame assembly, a transmission assembly, a first nozzle assembly, a second nozzle assembly, and a motor assembly. The transmission assembly comprises a primary transmission mechanism, a secondary transmission mechanism, a second nozzle transmission mechanism, and a synchronous belt. The motor assembly is used to drive the primary transmission mechanism to rotate. The second nozzle assembly is located on the second nozzle transmission assembly, and the first nozzle assembly is located on the primary transmission mechanism and/or the secondary transmission mechanism. The frame assembly comprises an upper cover and a lower cover, the first nozzle assembly and the second nozzle assembly being located on the lower cover, a water flow channel being provided in the lower cover, and the water flow channel being in communication with the second nozzle assembly and the first nozzle assembly.

11 Claims, 7 Drawing Sheets

(56) References Cited

U.S. PATENT DOCUMENTS

| | | | | |
|---|---|---|---|---|
| 7,086,353 | B2 * | 8/2006 | Hwang | F22B 37/003 122/379 |
| 8,016,950 | B2 * | 9/2011 | Kim | F28G 3/166 134/167 R |
| 8,181,890 | B2 * | 5/2012 | Zilai | B08B 9/0936 134/191 |
| 8,418,662 | B2 * | 4/2013 | Kim | F22B 37/003 122/363 |
| 9,896,299 | B2 * | 2/2018 | Barnes | F28G 15/04 |
| 10,449,563 | B2 * | 10/2019 | Zilai | B05B 13/0636 |
| 10,744,537 | B2 * | 8/2020 | Fujita | B05B 3/02 |
| 12,502,685 | B1 * | 12/2025 | Nie | B05B 15/18 |
| 2004/0089329 | A1 * | 5/2004 | Bijster | B08B 9/0936 134/167 R |
| 2014/0020717 | A1 * | 1/2014 | Schoening | B08B 9/0813 239/227 |
| 2017/0156557 | A1 * | 6/2017 | Fujita | B05B 3/02 |
| 2020/0056851 | A1 * | 2/2020 | Watkins | F28G 15/04 |
| 2020/0232729 | A1 * | 7/2020 | Schneider | G01D 9/005 |
| 2021/0131755 | A1 * | 5/2021 | Kim | F28G 9/00 |
| 2021/0345853 | A1 * | 11/2021 | Zhang | B05B 1/044 |
| 2021/0379609 | A1 * | 12/2021 | Xue | A47L 15/4278 |
| 2022/0016647 | A1 * | 1/2022 | Klinkhammer | B08B 3/024 |

* cited by examiner

MULTI-DIRECTIONAL JET CLEANING APPARATUS FOR STEAM GENERATOR

FIELD

The invention relates to the technical field of cleaning steam generator cleaning, and in particular involves a steam generator cleaning apparatus with multi-directional jets suitable for use in confined spaces.

BACKGROUND

The steam generator is an important equipment used for heat exchange in the primary and secondary circuits of a nuclear power plant. It has tens of thousands of tube bundles installed inside. Every time a nuclear power plant shutting down for maintenance, the secondary side tube bundles of the steam generator should be cleaned. With steam generators of the third generation of nuclear power technology putting into use, the development of its cleaning technology and equipment is also necessary. For example, the third internal structure of the steam generator designed by B&W company is more special, with heat transfer tubes arranged in equilateral triangles and the center lane area empty, without partitions; however, the center lane is narrower with the width only about 100 mm. In the case of ensuring the parameters of the jet and the straightness of the jet, the nozzle assembly arranged symmetrically on both sides is not applicable, which brings a greater challenge to the design of the cleaning mechanism.

The current main stream cleaning mechanism consists of two parts, one for cleaning in the 90° direction with the center lane and the other for cleaning in the 30° or 150° direction with the center lane. These two cleaning mechanisms are used alternately, resulting in a longer cleaning time. The cleaning process typically follows the sequence of 90°-30-150°-90°, but the intermediate process requires dismantling and replacing the cleaning mechanism, which increases personnel exposure to radiation dosage and labor.

The invention with Chinese application number 201210550000.X, titled A Sludge Spray Gun with Multi-Nozzle Structure is about a spray gun that can spray in three different directions. However, the disclosure indicates that the angled nozzle assembly of the spray gun is unilaterally arranged only, which does not meet the requirement for a bilateral arrangement of the nozzles and a consistent rotation direction of the bilateral nozzles. Additionally, the disclosure lacks clarity regarding the transmission between the motor and gear shaft, as well as the design of the waterway arrangement and circulation. This makes it impossible for those skilled in the art to realize the design of the cleaning mechanism with multi-directional nozzles arranged bilateral and asymmetrically based on the disclosure. Therefore, there is an urgent need to design an efficient cleaning mechanism that can adapt to use in narrow environments, and it can achieve multi-directional jets through bilaterally and asymmetrically arranged nozzles and no need to replace cleaning mechanism.

SUMMARY

In view of this technology, in order to overcome the shortcomings of the existing technology, this invention is designed to provide a jet cleaning apparatus applicable to a steam generator, wherein the nozzles are arranged bilaterally to enable efficient cleaning with multi-directional jets, and there is no need to replace the cleaning mechanism during the cleaning process.

To achieve these objectives, the present invention utilizes the following technical solutions:

A multi-directional jet cleaning apparatus for a steam generator comprises a frame assembly, and a transmission assembly, a first nozzle assembly and a second nozzle assembly located on the frame assembly, and a motor assembly used to drive the transmission assembly.

The transmission assembly comprises a primary transmission mechanism, a sub-transmission mechanism, a second nozzle transmission mechanism, and a synchronous belt for implementing synchronous rotation of the primary transmission mechanism, the sub-transmission mechanism, and the second nozzle transmission mechanism. The motor assembly is used to drive the primary transmission mechanism to rotate. The second nozzle assembly is located on the second nozzle transmission assembly, and the first nozzle assembly is located on the primary transmission mechanism and/or the sub-transmission mechanism.

The frame assembly comprises an upper cover and a lower cover, the first nozzle assembly and the second nozzle assembly are located on the lower cover; a water flow channel is provided in the lower cover and a plurality of the first nozzle assemblies is located asymmetrically on both sides of a central line in the lengthwise direction of the lower cover. The water flow channel is located in the lower cover and is in communication with the second nozzle assembly and the first nozzle assembly. The extension direction of the nozzles in the second nozzle assembly is not parallel to that of the nozzles in the first nozzle assembly, which enables the cleaning of tube bundles in different directions.

In the present invention, nozzle assemblies with different angles are integrated in the same cleaning apparatus. To achieve this, the position design of the first nozzle assembly and the second nozzle assembly must align the center of the nozzles with the gap of one tube bundle of the steam generator. This means that one nozzle is aligned with the center of the gap of a tube bundle, and the remaining nozzles are aligned with the gap centers of their corresponding tube bundles as a result. Furthermore, in order to meet the requirements of the cleaning coverage area, it is necessary to design the transmission ratios of the drive mechanism based on the required range of rotation angles of a first nozzle assembly and a second nozzle assembly. For example, a rotation of ±75° for a 90° nozzle assembly and ±85° for a 30-150° nozzle assembly can be achieved simultaneously.

In some preferred embodiments of the invention, the motor assembly comprises a motor and a first bevel gear located at an output end of the motor, with the motor being used to rotate the first bevel gear, and the first bevel gear is in contact with the primary transmission mechanism.

In some preferred embodiments of the invention, the primary transmission mechanism comprises a first rotating shaft, and a second bevel gear, a driving synchronous wheel, a driving spur gear, and a third bevel gear located outside of the first rotating shaft in order from top to bottom, the second bevel gear meshes with the first bevel gear; and the third bevel gear is in contact with the first nozzle assembly.

In some preferred embodiments of the invention, the sub-transmission mechanism comprises a second rotating shaft, and a driven synchronous wheel, a driven spur gear, and a fourth bevel gear located outside the second rotating shaft in order from top to bottom; the fourth bevel gear is in contact with the first nozzle assembly.

In some preferred embodiments of the invention, the driving synchronous wheel and the driven synchronous wheel are located in the same plane, and the synchronous belt is set on the driving synchronous wheel and the driven synchronous wheel.

In some preferred embodiments of the invention, the first nozzle assembly comprises a rotating shaft, and a first seal ring, a first nozzle bevel gear, a first nozzle bearing, a fixed plate and a nozzle holder located sequentially outside the rotating shaft. The first nozzles are located on the nozzle holder; a first flow is provided in the rotating shaft for connecting the water flow channel and the first nozzle. The fixed plate is rigidly mounted on the lower cover, and the first nozzle bevel gear meshes with the third bevel gear or the fourth bevel gear.

In some preferred embodiments of the invention, the first nozzle assembly comprises a transition ring and a first nozzle secondary bearing, with the first nozzle secondary bearing and the first nozzle bearing located on either side of the first nozzle bevel gear respectively. The transition ring is located between the first seal ring and the first nozzle secondary bearing; the fixed plate is fixed to the outer ring of the first nozzle bearing, the transition ring is fixed to the outer ring of the first nozzle secondary bearing, and the inner ring of the first nozzle bearing, the inner ring of the first nozzle secondary bearing, the first nozzle bevel gear and the nozzle holder are rigidly connected to the rotating shaft.

In some preferred embodiments of the invention, the transmission assembly further comprises a sub-transmission mechanism in contact with the primary transmission mechanism and/or sub-transmission mechanism, with the sub-transmission mechanism comprising a third rotating shaft, and a sub-spur gear and a sub-bevel gear placed outside of the third rotating shaft in order from top to bottom. The sub-spur gear is engaging with the driving or driven spur gear, the first nozzle assembly is located on the sub-transmission mechanism accordingly, and the sub-bevel gear meshes with the first nozzle bevel gear.

In some preferred embodiments of the invention, the lower cover is provided with a holding slot for accommodating a portion of the first nozzle assembly and a driving slot used for exposure of the first nozzle bevel gear, with the first nozzle bevel gear passing through the driving slot to engage with the bevel gears located at the lower end of the primary transmission mechanism, secondary transmission mechanism, and sub-transmission mechanism.

In some preferred embodiments of the invention, the second nozzle transmission mechanism comprises a fourth rotating shaft, an auxiliary synchronous wheel, an auxiliary bearing and an auxiliary bevel gear placed outside the fourth rotating shaft in order from top to bottom, with the auxiliary bearing being fixed to the lower cover and the auxiliary synchronous wheel being in contact with the synchronous belt for synchronous rotation.

In some preferred embodiments of the invention, the second nozzle assembly comprises a rotating frame, a second nozzle bevel gear socketed to the rotating frame, a mounting frame rotationally connected to both ends of the rotating frame, and a second nozzle located on the rotating frame, with the mounting frame being rigidly mounted to the frame assembly, the second nozzle bevel gear meshing with the auxiliary bevel gear, and a second flow channel being provided in the rotating frame for communicating with the water flow channel to the second nozzle.

In some preferred embodiments of the invention, a second nozzle bearing is located between the rotating frame and the mounting frame, with a second seal ring being located at both ends of the rotating frame; the rotating frame is provided with two or more second nozzles, and the second nozzles are symmetrically located on both sides of the second nozzle bevel gear.

In some preferred embodiments of the invention, the center lines of the first rotating shaft, the second rotating shaft, the third rotating shaft and the fourth rotating shaft do not lie in a straight line along the length of a frame assembly, with a main bearing being provided at the upper end of the rotating shaft, and the main bearing being secured to the upper cover; a cavity is formed between the upper cover and the lower cover, and the driving synchronous wheel, the driven synchronous wheel, the driving spur gear, the driven spur gear, and the synchronous belt are accommodated in the cavity.

In some preferred embodiments of the invention, the water flow channel comprises a main branch section of a waterway, a first branch section connecting the main branch section of the waterway with the first flow channel, and a second branch section connecting the main branch section of the waterway with the second flow channel. In some embodiments of the present application, in order to ensure water flow rate, the main branch section of the waterway is designed in an elliptical cross-section, comprising an inclined section at the inlet and a horizontal section, the inclined section sloping downwards from the inlet, the horizontal section being located below the first nozzle assembly and the second nozzle assembly; the first branch section and the second branch section are in communication with the horizontal section. The first branch section is located vertically and the second branch section is located at an angle. More specifically, a first nozzle assembly is provided on both sides of a horizontal section, and two first branch sections are staggered from each other and distributed on both sides of the axis of the horizontal section. A second branch transition section is also provided between a second branch section and a second flow channel, and the second branch section and the second branch transition section are vertically located for introducing water flow in the horizontal section into the second flow channel through the second branch section and the second branch transition section.

In some preferred embodiments of the invention, each of the first nozzle assemblies is located on one side of extension of the main branch section of the waterway, and two first nozzle assemblies of each group are located asymmetrically on both sides of the main branch section of the waterway; the connections of the first branch sections corresponding to two first nozzle assemblies of each group and the main branch section of the waterway are located on either side of a short axis of the main branch section of the elliptical waterway respectively and asymmetrically located on either side of the short axis.

In some preferred embodiments of the invention, the transmission assembly comprises a tensioning mechanism, with the tensioning mechanism comprising a fixed seat, and a fixed shaft and an adjusting synchronous wheel fixed to the fixed seat; The adjusting synchronous wheel is in contact with a synchronous belt and rotating synchronously.

In some preferred embodiments of the invention, the lower cover is provided with a set of second nozzle assembly as well as a first nozzle assembly symmetrically located on both sides of the second nozzle assembly. The second nozzle transmission mechanism is located between the primary transmission mechanism and the sub-transmission mechanism, and the jet directions of the nozzles in the first nozzle assembly are all directed towards the center of the tube bundles.

By adopting the above technical solutions, the present invention is advantageous over the prior art in that the multi-directional jet cleaning apparatus for steam generators has a reasonable and compact structural design, integrates the 90° nozzle assembly and the 30-150° nozzle assembly in the same cleaning apparatus, so as to realize the asymmetric arrangement of the nozzles on both sides, achieve the highly-efficient cleaning of multi-directional jet, and solve the problems of replacement and low cleaning efficiency of cleaning mechanism.

BRIEF DESCRIPTION OF THE DRAWINGS

In order to more clearly illustrate the technical solutions in the embodiments of the present invention, the accompanying drawings to be used in the description of the embodiments will be briefly introduced below. It will be apparent that the accompanying drawings in the following description are only some of the embodiments of the present invention, and those persons of ordinary skill in the art will be able to obtain other accompanying drawings from these accompanying drawings without creative labor.

Figure 1:
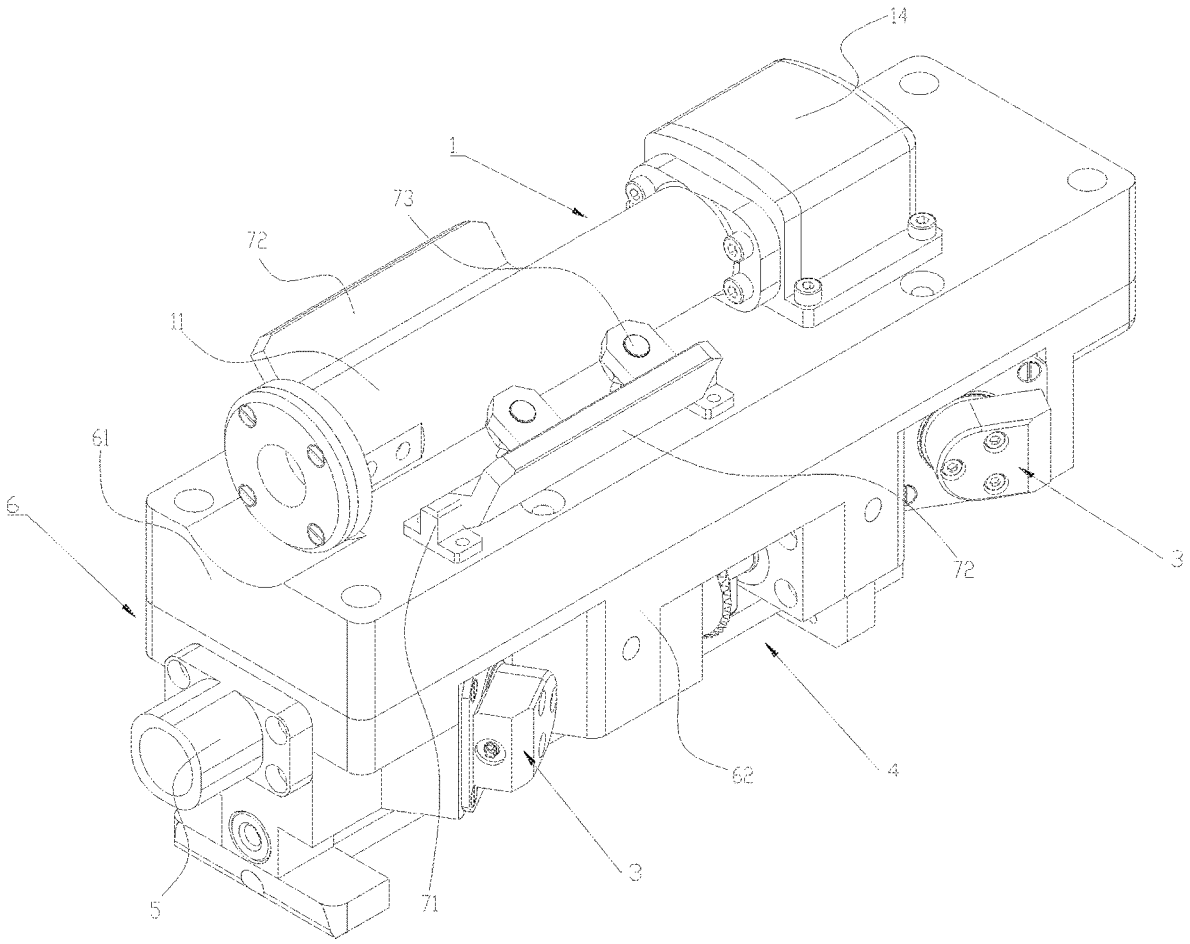
FIG. 1 shows a three-dimensional view of a multi-directional jet cleaning apparatus from a first angle projection in a preferred embodiment of the present invention.
Figure 2:
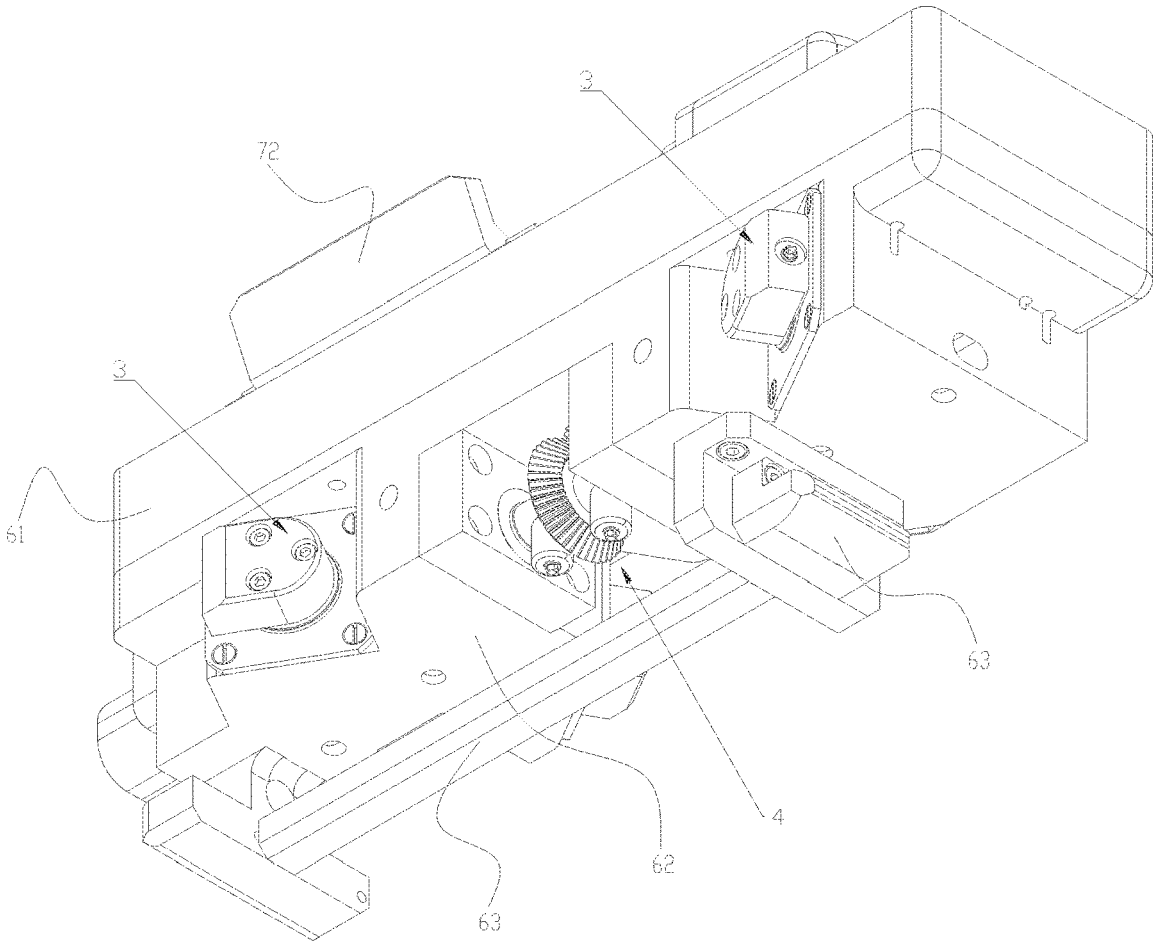
FIG. 2 shows a three-dimensional view of a multi-directional jet cleaning apparatus from a second angle projection in a preferred embodiment of the present invention.
Figure 3:
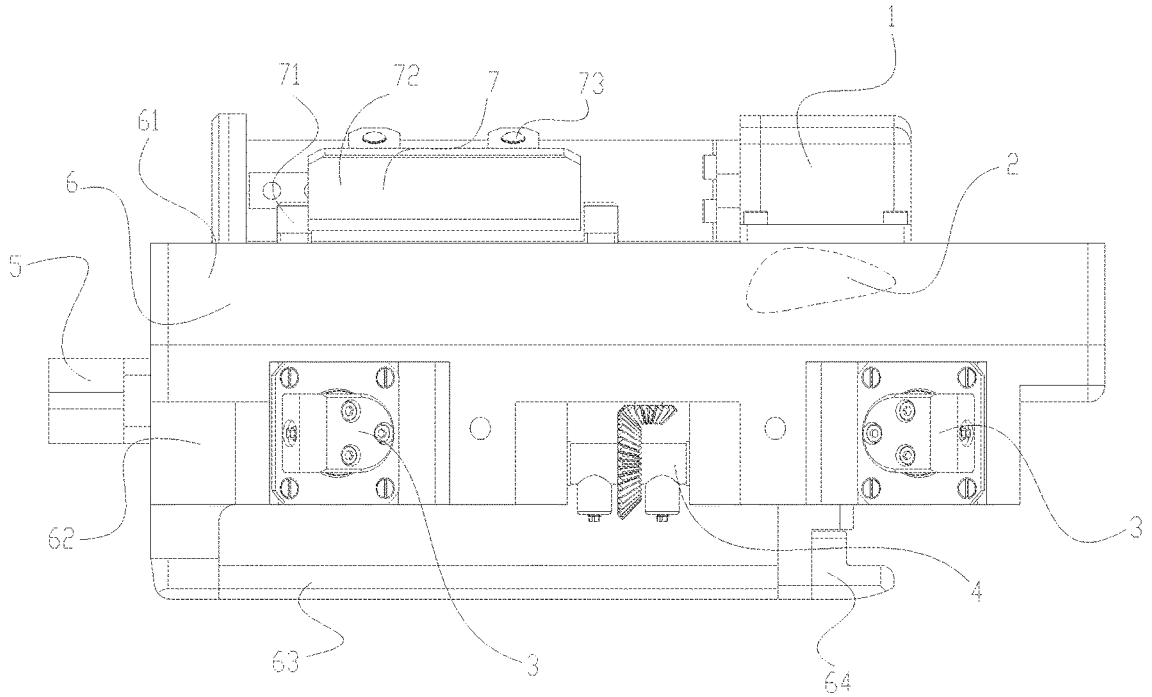
FIG. 3 shows a front view of a multi-directional jet cleaning apparatus in a preferred embodiment of the present invention.

In the accompanying drawings, 1. motor assembly; 11. motor seal housing; 12. motor; 13. first bevel gear; 14. seal cover; 2. transmission assembly; 21. primary transmission mechanism; 211. first rotating shaft; 212. second bevel gear; 213. driving synchronous wheel; 214. driving spur wheel; 215. third bevel gear; 22. sub-transmission mechanism; 221, second rotating shaft; 222. driven synchronous wheel; 223. driven spur gear; 224. fourth bevel gear; 23. sub-transmission mechanism; 231. third rotating shaft; 232. sub-spur gear; 233. sub-bevel gear; 24. second nozzle transmission mechanism; 241. fourth rotating shaft; 242. auxiliary synchronous wheel; 243. auxiliary bearing; 244. auxiliary bevel gear; 245. fixed nut; 25. tensioning mechanism; 251. fixed seat; 252. fixed shaft; 253. adjusting synchronous wheel; 26. synchronous belt; 27. main bearing; 3. 30-150° nozzle assembly; 31. rotating shaft; 32. first seal ring; 33. transition ring; 34. first nozzle secondary bearing; 35. first nozzle bevel gear; 36. first nozzle bearing; 37. fixed plate; 38. nozzle holder; 39. first nozzle; 310. first flow channel; 4. 90° nozzle assembly; 41. mounting frame; 42. second nozzle bearing; 43. rotating frame, 44. second nozzle bevel gear; 45. second nozzle; 46. second seal ring; 47. second flow channel; 5. water inlet; 6. frame assembly; 61. upper cover; 62. lower cover; 621. main branch section of waterway; 622. 30-150° branch section; 623. 90° branch section; 625. handle; 626. weight reduction slot; 627. holding slot; 628. driving slot. 63. junction plate; 64. limit stop; 7. sensor assembly; 71. rotating support; 72. mounting plate; 73. proximity sensor.

DESCRIPTION OF THE EMBODIMENTS

In order to enable a person of ordinary skill in the art to better understand the technical solutions of the present invention, the technical solutions in the embodiments of the present invention will be described clearly and completely with the accompanying drawings in the embodiments of the present invention, and it is apparent that the described embodiments are only a part of the embodiments of the present invention, rather than all embodiments. Based on the embodiments in the present invention, all other embodiments obtained by a person of ordinary skill in the art without creative labor shall fall within the scope of protection of the present invention.

The purpose of the present invention is to provide a multi-directional jet cleaning apparatus for steam generators in nuclear power plants, so as to overcome the shortcomings of the single-directional jet cleaning mechanism currently used in nuclear power plants at home and abroad in terms of inconvenient replacement and disassembly during operation and low working efficiency. The present invention uses a motor assembly that employs a transmission assembly to drive a 30-150° nozzle assembly (first nozzle assembly) and a 90° nozzle assembly (second nozzle assembly) water jets to rotate between tube bundles at the same time, so as to cover all areas between tube bundles to enhance cleaning effect and efficiency. The invention aims to achieve multi-directional jets for better cleaning by using multiple bilateral asymmetric first nozzle assemblies and second nozzle assemblies while ensuring the small width of the entire cleaning apparatus.

As shown in FIGS. 1-13, a multi-directional jet cleaning apparatus for a steam generator in this embodiment includes a frame assembly 6, and a transmission assembly 2, a first nozzle assembly, and a second nozzle assembly located on the frame assembly 6, and a motor assembly 11 used to drive the transmission assembly 2. In this embodiment, the first nozzle assembly is a 30-150° nozzle assembly 3, and the second nozzle assembly is a 90° nozzle assembly 4. The transmission assembly 2 comprises a primary transmission mechanism 21, a secondary transmission mechanism 22, a second nozzle transmission mechanism 24, a sub-transmission mechanism 23, and a synchronous belt 26 for synchronous rotation of the primary transmission mechanism 21, the secondary transmission mechanism 22, the second nozzle transmission mechanism 24, and the sub-transmission mechanism 23, and the motor assembly 11 used to drive the primary transmission mechanism 21 to rotate. The frame assembly 6 includes an upper cover 61 and a lower cover 62, the first nozzle assembly and the second nozzle assembly being located on the lower cover 62, a water flow channel being provided in the lower cover 62, and the water flow channel being connected to the second nozzle assembly and the first nozzle assembly to realize water supply. The extension direction of the nozzle of the second nozzle assembly is not parallel to the extension direction of the nozzle of the first nozzle assembly, to realize cleaning of the tube bundles in different directions.

A detailed description of each component is given below:

1. First Nozzle Assembly

Figure 6:
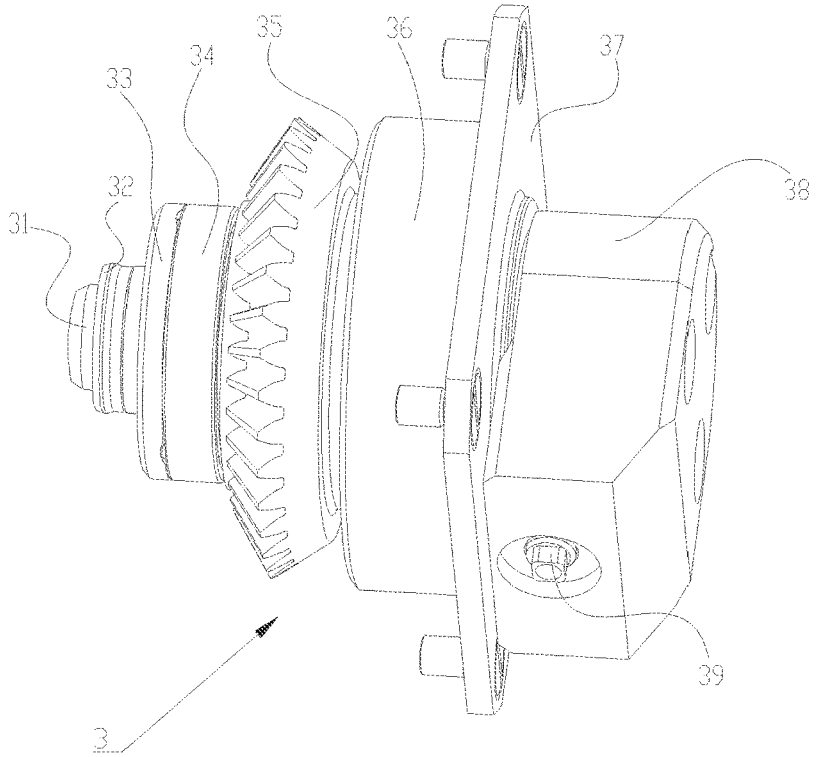
FIG. 6 shows a three-dimensional view of the first nozzle assembly in the multi-directional jet cleaning apparatus in a preferred embodiment of the present invention.
Figure 7:
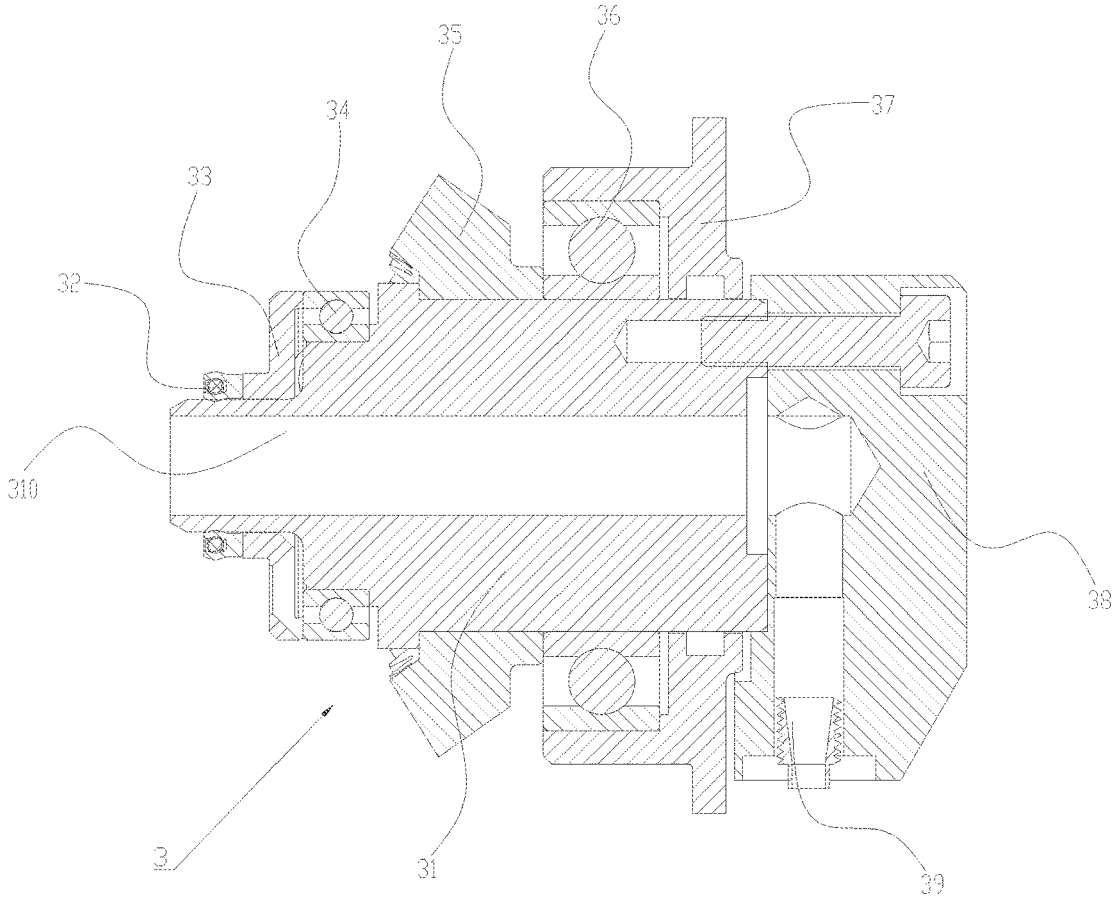
FIG. 7 shows a sectional view of a first nozzle assembly in a multi-directional jet cleaning apparatus in a preferred embodiment of the present invention.

As shown in FIGS. 6-7, the 30-150° nozzle assembly 3 (first nozzle assembly) in this embodiment includes a rotating shaft 31, and a first seal ring 32, a transition ring 33, a first nozzle secondary bearing 34, a first nozzle bevel gear 35, a first nozzle bearing 36, a fixed plate 37, and a nozzle holder 38 set outside of the rotating shaft 31 in sequence, and a first nozzle 39 located on the nozzle holder 38. The first nozzle 39 is provided to ensure the linearity of the water jet and thus the cleaning effect. The first nozzle secondary bearing 34 and the first nozzle bearing 36 are located on either side of the first nozzle bevel gear 35 respectively, and the transition ring 33 is located between the first seal ring 32 and the first nozzle secondary bearing 34.

The fixed plate 37 is fixed to the outer ring of the first nozzle bearing 36, and the transition ring 33 is fixed to the outer ring of the first nozzle secondary bearing 34, and the inner ring of the first nozzle bearing 36, the inner ring of the first nozzle secondary bearing 34, the first nozzle bevel gear 35, and the nozzle holder 38 are rigidly connected to the rotating shaft 31. A first flow channel 310 for connecting the water flow channel and the first nozzle 39 is provided in the rotating shaft 31, and the fixed plate 37 is rigidly mounted on the lower cover 62, and the first nozzle bevel gear 35 engages with the bevel gear in the transmission assembly 2.

2. Second Nozzle Assembly

Figure 8:
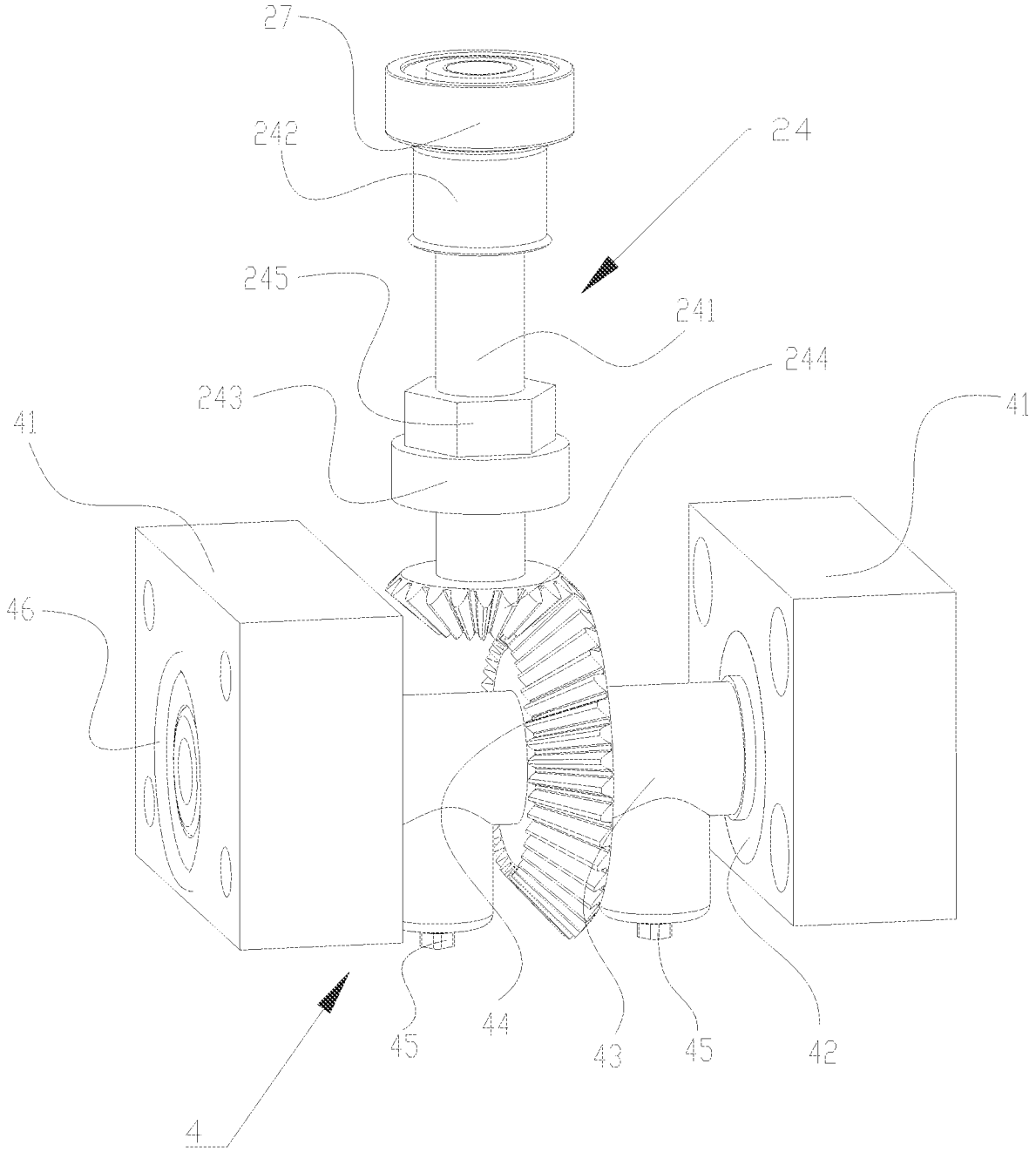
FIG. 8 shows a three-dimensional view of the second nozzle assembly in a multi-directional jet cleaning apparatus in a preferred embodiment of the present invention.
Figure 9:
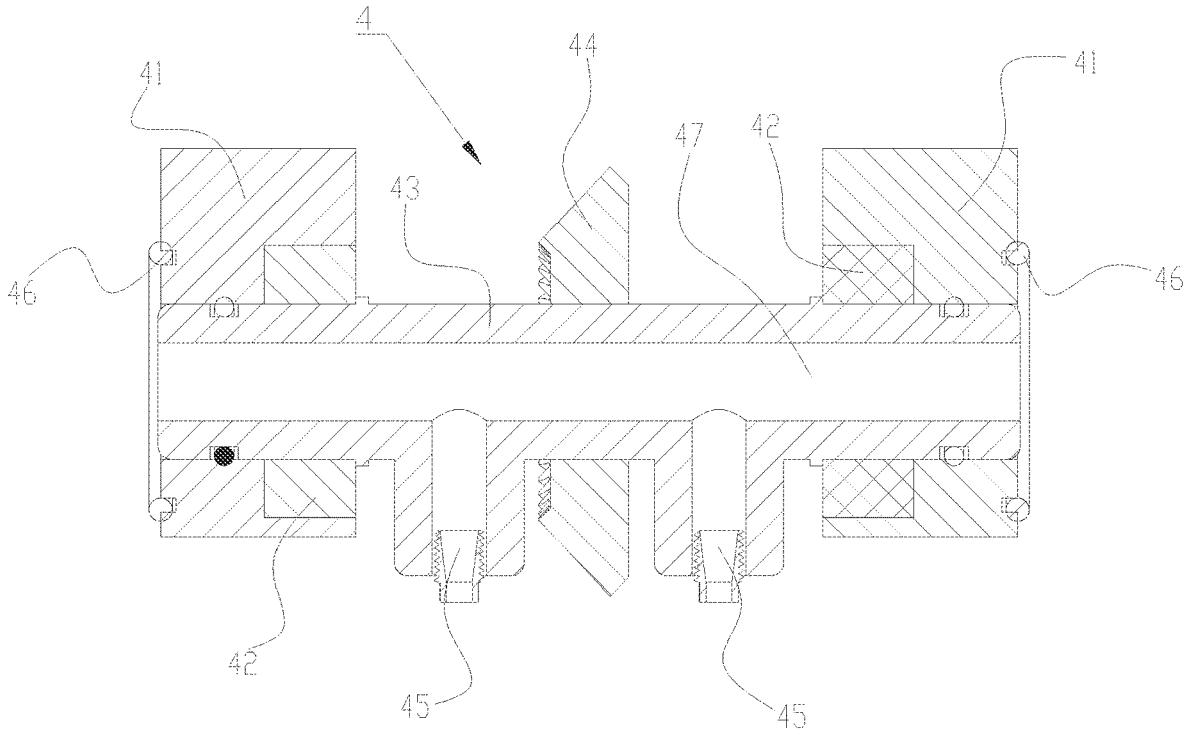
FIG. 9 shows a sectional view of a second nozzle assembly in a multi-directional jet cleaning apparatus in a preferred embodiment of the present invention.
Figure 10:
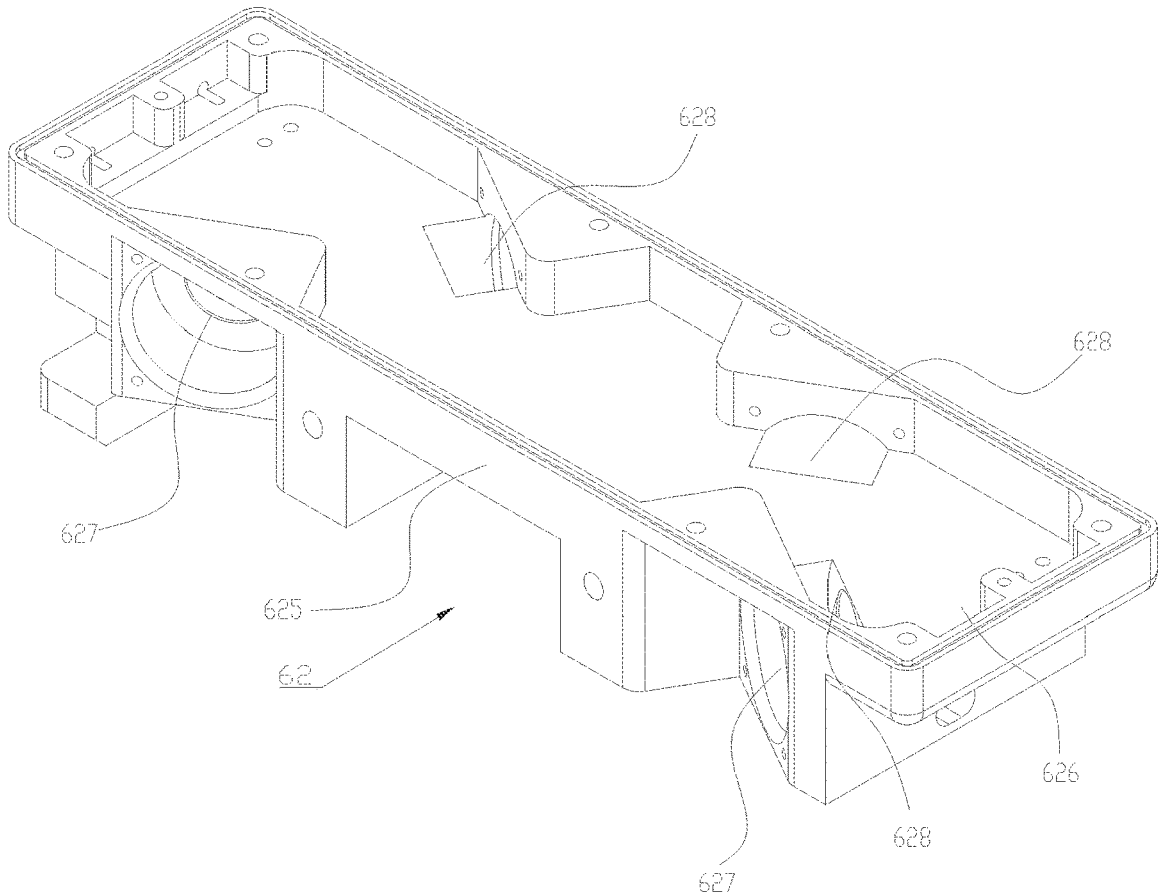
FIG. 10 shows a three-dimensional view of a lower cover in a multi-directional jet cleaning apparatus in a preferred embodiment of the present invention.

As shown in FIGS. 7-8, the 90° nozzle assembly 4 (second nozzle assembly) in this embodiment includes a rotating frame 43, a second nozzle bevel gear 44 socketed on the rotating frame 43, a mounting frame 41 attached to both ends of the rotating frame 43, a second nozzle bearing 42 mounted between the rotating frame 43 and the mounting frame 41, and a second nozzle 45 located on the rotating frame 43. The mounting frame 41 is rigidly mounted on a frame assembly 6, and the second nozzle bevel gear 44 engages with a bevel gear on the second nozzle transmission mechanism 24, and a second flow channel 47 is provided in the rotating frame 43 for connecting the water flow channel and the second nozzles 45. A second seal ring 46 is provided at both ends of the rotating frame 43. Two second nozzles 45 are located on the rotating frame 43 symmetrically with respect to the second nozzle bevel gear 44 in this embodiment.

3. Motor Assembly 11

Figure 4:
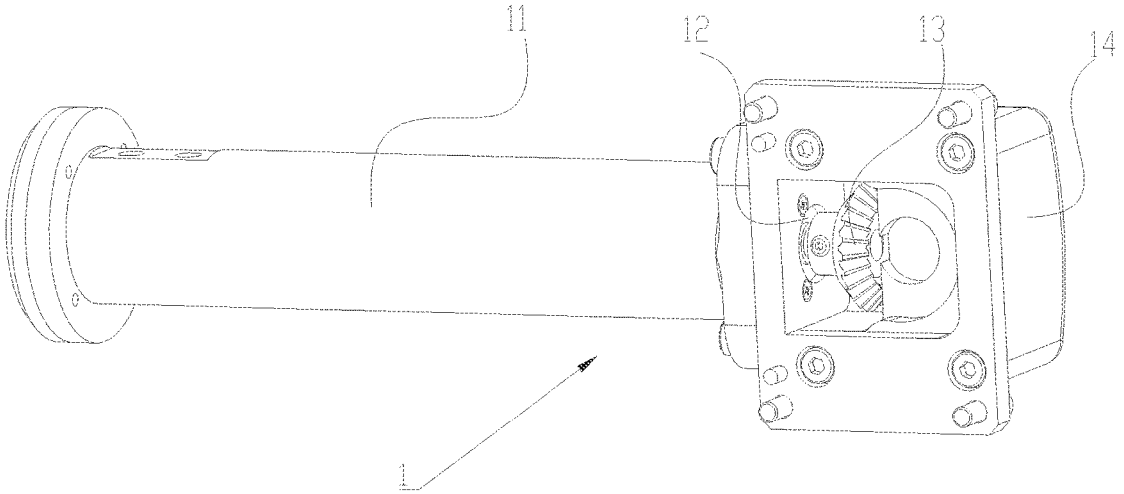
FIG. 4 shows a three-dimensional view of the motor assembly in a multi-directional jet cleaning apparatus in a preferred embodiment of the present invention.

As shown in FIG. 4, a motor assembly 11 in this embodiment is mounted on the upper cover 61 of the frame assembly 6, and includes a motor seal shell 11, a motor 12, a first bevel gear 13, and a seal cover 14. The output shaft of the motor 12 is connected to the first bevel gear 13 for driving the first bevel gear 13 to rotate; the motor 12 is mounted in the motor seal shell 11, and together with the seal cover 14, forms a sealed environment for the motor 12.

4. Transmission Assembly 2

Figure 5:
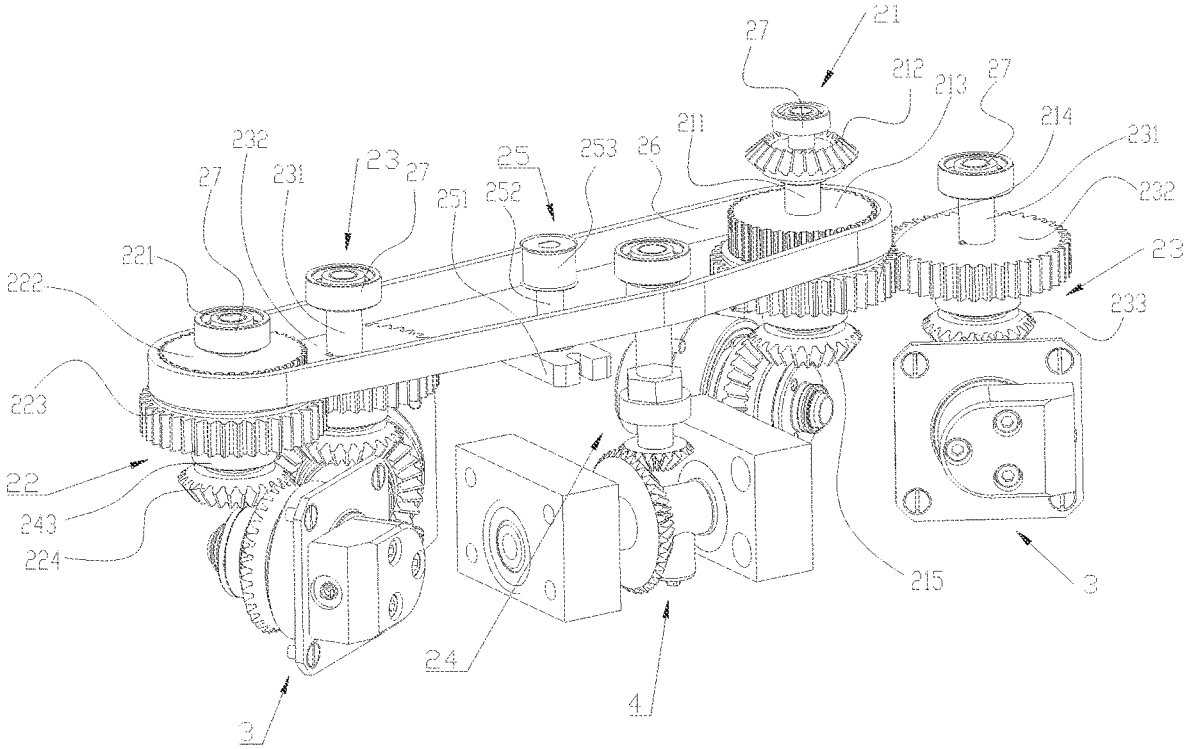
FIG. 5 shows a three-dimensional view of a transmission assembly in a multi-directional jet cleaning apparatus in a preferred embodiment of the present invention.

As shown in FIG. 5, the transmission assembly 2 in this embodiment comprises a synchronous belt 26, a primary transmission mechanism 21 in contact with the synchronous belt 26, a secondary transmission mechanism 22, a second nozzle transmission mechanism 24, a tensioning mechanism 25, and a sub-transmission mechanism 23 driven to rotate by either the primary transmission mechanism 21 or the secondary transmission mechanism 22.

The primary transmission mechanism 21 includes a first rotating shaft 211, a main bearing 27, a second bevel gear 212, a driving synchronous wheel 213, a driving spur gear 214, an auxiliary bearing 243, and a third bevel gear 215 set outside the first rotating shaft 211 in order from top to bottom; the second bevel gear 212 engages with the first bevel gear 13; and the third bevel gear 215 engages with the first nozzle bevel gear 35 of the first nozzle assembly.

A secondary transmission mechanism 22 comprises a second rotating shaft 221, and a main bearing 27, a driven synchronous wheel 222, a driven spur gear 223, an auxiliary bearing 243 and a fourth bevel gear 224 located outside the second rotating shaft 221 in order from top to bottom; the fourth bevel gear 224 meshes with a first nozzle bevel gear 35 of the first nozzle assembly. The driving synchronous wheel 213 and the driven synchronous wheel 222 are located in the same plane, and the synchronous belt 26 is set on the driving synchronous wheel 213 and the driven synchronous wheel 222.

The sub-transmission mechanism 23 includes a third rotating shaft 231, and a main bearing 27, a sub-spur gear 232, an auxiliary bearing 243, and a sub-bevel gear 233 set outside the third rotating shaft 231 in order from top to bottom; the sub-spur gear 232 meshes with the driving spur gear 214 or the driven spur gear 223, and a first nozzle assembly is located on the sub-transmission mechanism correspondingly, and the sub-bevel gear 233 meshes with a first nozzle bevel gear 35.

A second nozzle transmission mechanism 24 includes a fourth rotating shaft 241, and a main bearing 27, an auxiliary synchronous wheel 242, a fixed nut 245, an auxiliary bearing 243, and an auxiliary bevel gear 244 set outside the fourth rotating shaft 241 in order from top to bottom; the auxiliary bevel gear 244 and a second nozzle bevel gear 44 in the second nozzle set assembly form a bevel gear set. A fixed nut 245 and an auxiliary bearing 243 are secured on the lower cover 62, and the auxiliary synchronous wheel 242 is in contact with the synchronous belt 26 for synchronous rotation.

The tensioning mechanism 25 includes a fixed seat 251, a fixed shaft 25 fixed to the fixed seat 251, and an adjusting synchronous wheel 253, which contacts and synchronously rotates with the synchronous belt 26. The fixed seat 251 has an adjusting groove, and the position of the adjusting synchronous wheel 253 is moved through the adjusting groove and the fixing member therein, thereby adjusting the tension of the synchronous belt 26.

In this embodiment, a main bearing 27 is located at the upper end of a first rotating shaft 211, a second rotating shaft 221, a third rotating shaft 231, and a fourth rotating shaft 241, and an auxiliary bearing 243 is located at the lower end of the first rotating shaft 211, the second rotating shaft 221, the third rotating shaft 231 and the fourth rotating shaft 241, and is located above the bevel gear, and the main bearing 27 is fixed to an upper cover 61. A cavity is formed between the upper cover 61 and the lower cover 62, and the driving synchronous wheel 213, the driven synchronous wheel 222, the driving spur gear 214, the driven spur gear 223, and the synchronous belt 26 are accommodated in the cavity. The position of each transmission mechanism and the stability of operation are ensured by the main bearing 27 and the auxiliary bearing 243.

5. Frame Assembly 6

As shown in FIGS. 1-3 and FIGS. 10-13, the frame assembly 6 in this embodiment includes an upper cover 61, a lower cover 62, a connecting plate 63, and a limit stop 64. The lower cover 62 is provided with a high-pressure water flow channel, including a main branch section of waterway 621, a 30-150° branch section 622 connecting the main branch section of waterway 621 to the first flow channel 310 of the 30-150° nozzle assembly 3, and a 90° branch section 623 connecting the main branch section of waterway 621 to the second flow channel 47 of the 90° nozzle assembly 4. High-pressure water enters the main branch section of waterway 621 from the water inlet 5, enters the first flow channel 310 through the 30-150° branch section 622, and then enters the first nozzle assembly, and is sprayed by the first nozzle 39; it enters the second flow channel 47 through the 90° branch section 623, and then enters the second nozzle assembly, and is sprayed by the second nozzle 45.

Figure 11:
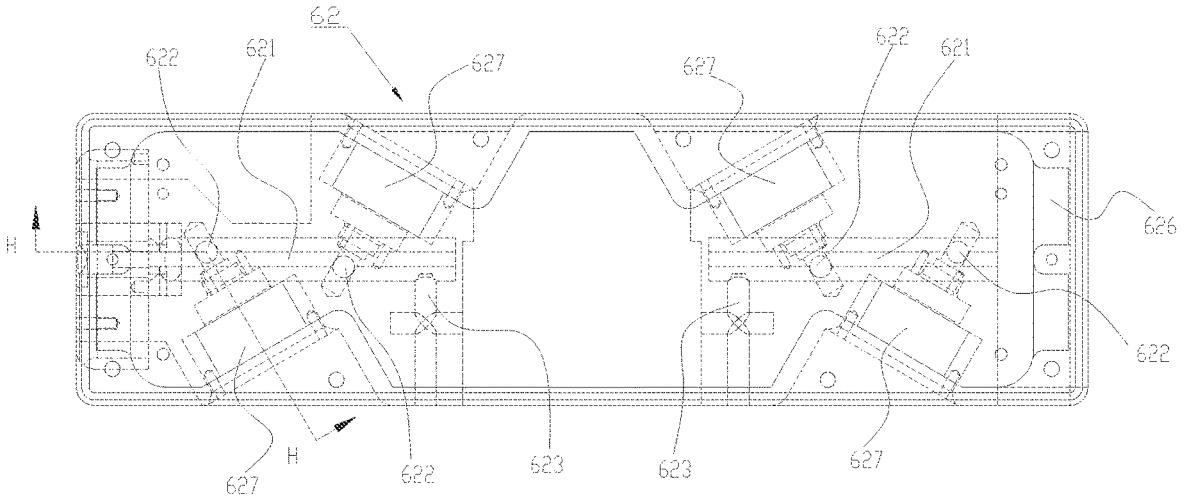
FIG. 11 shows a top view of the lower cover in a multi-directional jet cleaning apparatus in a preferred embodiment of the present invention.
Figure 12:
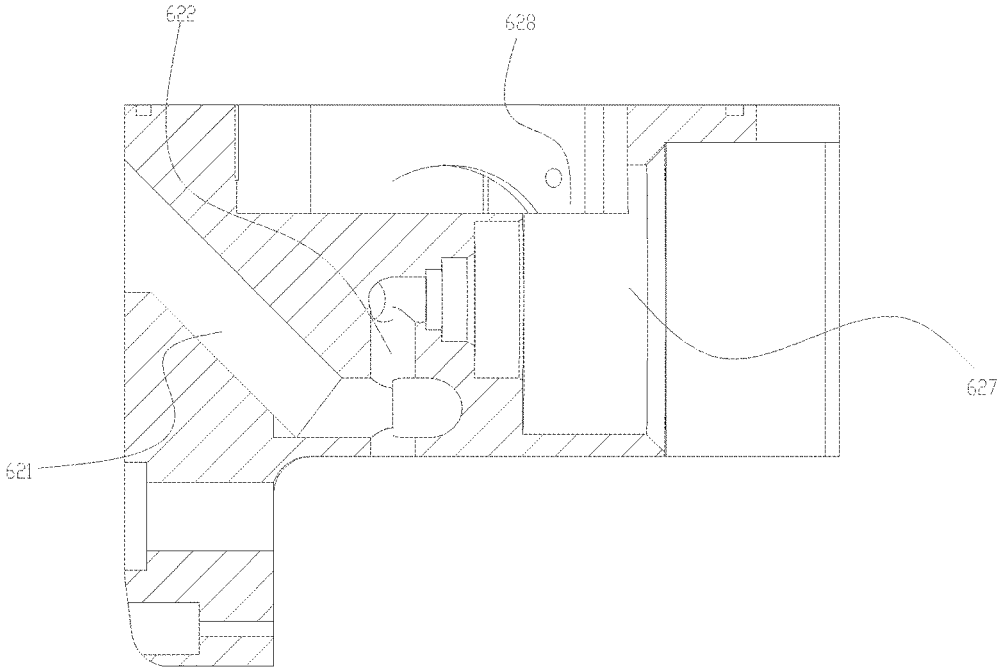
FIG. 12 shows a sectional view of H-H in FIG. 11.
Figure 13:
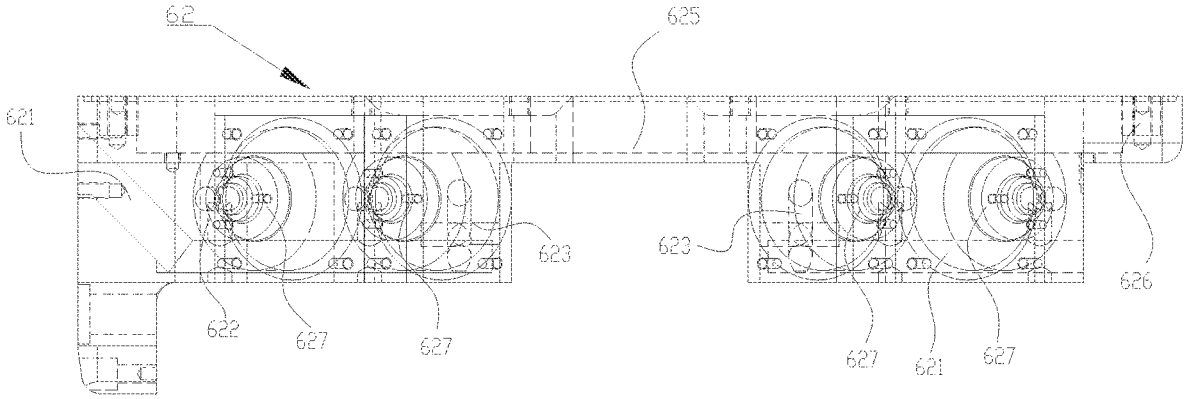
FIG. 13 shows a schematic view of a water flow channel in a lower cover of a multi-directional jet cleaning apparatus in a preferred embodiment of the present invention.

As shown in FIGS. 11-13, the main branch section of waterway 621 in this embodiment is designed to be elliptical in cross-section and includes an inclined section at the inlet and a horizontal section, with the inclined section sloping downwards from the inlet, and the horizontal section being located below the first nozzle assembly and the second nozzle assembly; the first branch section 622 and the second branch section 623 are connected to the horizontal section. The first branch section 622 is perpendicular to the horizontal section, and the second branch section 623 is inclined. More specifically, a first nozzle assembly 1 is located on both sides of the horizontal section, and two first branch sections 622 are staggered from each other and distributed on both sides of the axis of the horizontal section, i.e., they are located on both sides of the short axis of the elliptical main branch section of waterway and are asymmetrically located on either side of the short axis. A second branch transition section is also provided between the second branch section 623 and the second flow channel 47, and the second branch section 623 and the second branch transition section are located vertically for introducing water flow in the horizontal section into the second flow channel 47 through the second branch section 623 and the second branch transition section. Through the located waterway, the passage of the waterway is clear while ensuring the compact structure of the apparatus, and the waterway is easier to make. For example, when making the second branch section 623, the second branch transition section and the horizontal section are passed through from the outside to the inside, after which the outer end of the second branch section 623 is blocked, and other waterways are located in a similar manner.

As shown in FIG. 11, two groups of first nozzle assemblies are symmetrically located on both sides of the center line (the vertical direction of FIG. 11) in the width direction of a lower cover 62, and two first nozzle assemblies of each group are asymmetrically located on both sides of the center line (the horizontal direction of FIG. 11) in the length direction of a lower cover 62; in addition, as shown in FIG. 5, the corresponding driving mechanisms cannot be distributed in the one straight line, and the first rotating shaft, the second rotating shaft, the third rotating shaft and the fourth rotating shaft center lines are not in a straight line along the length direction of a frame assembly, and a synchronous belt is adopted for synchronous driving. With this disposition, the cleaning apparatus has a compact structure while ensuring effective transmission and cleaning.

In this embodiment, in order to ensure both the strength and convenience of carrying, the lower cover 62 is machined with multiple weight-reducing grooves 626; one of them is set as a handle 625. The upper cover 61 and the lower cover 62 are connected by bolts and seal strips, and the connecting plate 63 and the limit stop 64 are mounted on the bottom end of the lower cover 62, which is convenient for the whole cleaning apparatus to match with other mobile carriers; the inlet 5 is mounted on the end face of the lower cover 62 and is connected to the main branch section of waterway 621.

In this embodiment, the lower cover 62 is provided with a holding groove 627 for accommodating a portion of the first nozzle assembly, and a driving slot 628 used for exposure of the first nozzle bevel gear 35, and the first nozzle bevel gear 35 passes through the driving slot 628 to engage with the bevel gears on the lower end of the primary transmission mechanism 21, the secondary transmission mechanism 22, and the sub-transmission mechanism 23.

In this embodiment, the lower cover 62 is provided with a second nozzle assembly, and four first nozzle assemblies symmetrically located on both sides of the second nozzle assembly, the jet directions of the nozzles in each of the four first nozzle assemblies being different and differing from the jet directions of the second nozzles to achieve cleaning of the tube bundles in different directions. The second nozzle transmission mechanism 24 is located between the primary transmission mechanism 21 and the secondary transmission mechanism 22.

In this embodiment, the top cover 61 is also fitted with a sensor assembly 7, including a mounting plate 72, a proximity sensor 73 mounted on the mounting plate 72; the mounting plate 72 is mounted on the top cover 61 through a swiveling bracket 71 to adjust the angle of the mounting plate 72. The proximity sensor 73 is used to control the precise displacement of other moving carriers, allowing the nozzle to be aligned with the center of the pipe gap, and can be replaced with a small camera in some cases.

In the present invention, the multi-directional jet cleaning apparatus for steam generators in nuclear power plants includes a motor assembly, a transmission assembly, a 30-150° nozzle assembly, a 90° nozzle assembly, a water inlet, a frame assembly, and a sensor assembly. The motor assembly engages with the transmission assembly through a bevel gear set; the transmission assembly engages with the 90° nozzle assembly or the 30-150° nozzle assembly through a bevel gear set; the frame assembly is connected and mounted with the motor assembly, the 90° nozzle assembly and the 30-150° nozzle assembly, and a water supply channel is provided in the frame assembly for connection to the 90° nozzle assembly and the 30-150° nozzle assembly; the sensor assembly is mounted on the frame assembly to ensure that the multi-directional jet nozzles are right at the center of the pipe gap. The water jet direction of the 90° nozzle assembly and the 30-150° nozzle assembly is consistent with the distribution of the heat transfer tube bundles, and the rotation angle of the two assemblies should cover the cleaning distance of the tube bundles; the motor assembly, with power supply, can drive the 90° nozzle assembly and the 30-150° nozzle assembly to rotate according to the appropriate angle simultaneously, and achieve different angles of rotation of the two nozzles simultaneously through the same motor's forward and reverse rotation, so that the water jet is directly between the tubes, it can cover the whole area between the tube bundles to reduce the replacement of equipment during cleaning, ensure the effectiveness of cleaning, and enhance the cleaning efficiency, reduce the personal exposure to radiation dose during field operation.

In the present invention, the cleaning apparatus with multi-directional jet has the following advantages: the power source is a motor assembly, used to drive the 90°nozzle assembly and 30-150° nozzle assembly at the same time through a transmission assembly, and achieving multi-directional jet cleaning at each inter-tube position; the position and direction of the 90° nozzle assembly and the 30-150° nozzle assembly jets are consistent with tube gaps of the heat transfer tube bundles to ensure that the water can be injected into the area between the tubes; in addition, the design of the driving system makes the rotating angles of 90° nozzle assembly and 30-150° nozzle assembly to cover the whole area cleaning; the design of the high-pressure waterway makes it possible to meet the requirements of space and strength, flow rate and the seal, as well as the flow rate of the multi-directional jet cleaning structure in terms of the high-pressure water supply.

The above embodiments only serve to illustrate the technical concepts and features of the present invention, enabling those familiar with the technology to understand the content of the present invention and implement it accordingly. They do not, however, restrict the scope of protection of the present invention in this way. Any equivalent changes or modifications made based on the substance of the present invention shall be covered within the scope of protection of the present invention.

What is claimed is:

1. A multi-directional jet cleaning apparatus for a steam generator, comprising a frame assembly, and a transmission assembly, a first nozzle assembly and a second nozzle assembly located on the frame assembly, and a motor assembly used to drive the transmission assembly;

the transmission assembly comprises a primary transmission mechanism, a secondary transmission mechanism, a second nozzle transmission mechanism, and a synchronous belt for synchronous rotation of the primary transmission mechanism, the secondary transmission mechanism, and the second nozzle transmission mechanism; the motor assembly is used to drive the primary transmission mechanism; the second nozzle transmission mechanism is provided with a second nozzle assembly, and the primary transmission mechanism and/or the secondary transmission mechanism are provided with a first nozzle assembly;

the frame assembly comprises an upper cover and a lower cover, the first nozzle assembly and the second nozzle assembly located on the lower cover, a plurality of first nozzle assemblies asymmetrically located on both sides of a center line in a lengthwise direction of the lower cover, the lower cover provided with a water flow channel, the water flow channel being in communication with the second nozzle assembly and the first nozzle assembly;

wherein the motor assembly comprises a motor and a first bevel gear located at the output end of the motor, the motor being used to drive the first bevel gear to rotate, the first bevel gear being in contact with the primary transmission mechanism;

the primary transmission mechanism comprises a first rotating shaft, and a second bevel gear, a driving synchronous wheel, a driving spur gear, and a third bevel gear set outside the first rotating shaft in order from top to bottom; the second bevel gear engaging with the first bevel gear; the third bevel gear being in contact with the first nozzle assembly; and the secondary mechanism comprises a second rotating shaft and a driven synchronous wheel, a driven spur gear and a fourth bevel gear set outside the second rotating shaft in order from top to bottom; the fourth bevel gear being in contact with the first nozzle assembly.

2. The multi-directional jet cleaning apparatus according to claim 1, wherein the first nozzle assembly comprises a rotating shaft and a first seal ring, a transition ring, a first nozzle secondary bearing, a first nozzle bevel gear, a first nozzle bearing, a fixed plate and a nozzle holder sequentially set outside the rotating shaft, with the first nozzle holder being provided with a first nozzle, a first flow channel being provided in the rotating shaft to connect the water flow channel and first nozzle, the fixed plate being rigidly mounted on the lower cover; the first nozzle bevel gear engaging with the third bevel gear or fourth bevel gear; the first nozzle secondary bearing and the first nozzle bearing being located on each side of the first nozzle bevel gear respectively, the transition ring being located between the first seal ring and first nozzle secondary bearing; the fixed plate being fixed with the outer ring of the first nozzle bearing, the transition ring being fixed with the outer ring of the first nozzle secondary bearing, and the inner ring of the first nozzle bearing, inner ring of the first nozzle secondary bearing, first nozzle bevel gear, and nozzle holder being rigidly connected to the rotating shaft.

3. The multi-directional jet cleaning apparatus according to claim 1, wherein the transmission assembly further comprises a sub-transmission mechanism in contact with the primary and/or secondary transmission mechanism, the sub-transmission mechanism comprising a third rotating shaft, and a sub-spur gear and a sub-bevel gear set outside of the third rotating shaft in order from top to bottom, the sub-spur gear engaging with the driving or driven spur gear, the first nozzle assembly being located on the sub-transmission mechanism accordingly, the sub-bevel gear engaging with the first nozzle bevel gear.

4. The multi-directional jet cleaning apparatus according to claim 3, wherein the lower cover is provided with a holding slot for accommodating a portion of the first nozzle assembly and a driving slot used for exposure of the first nozzle bevel gear, and the first nozzle bevel gear passes through the driving slot to engage with the bevel gears located at the lower end of the primary transmission mechanism, secondary transmission mechanism, and sub-transmission mechanism; the lower cover is provided with a set of second nozzle assemblies and two sets of first nozzle assemblies symmetrically located on both sides of the second nozzle assembly, with each set of first nozzle assembly comprising two first nozzle assemblies; the second nozzle transmission mechanism is located between the primary transmission mechanism and the secondary transmission mechanism, and a sensor assembly is located on the upper cover for assisting in locating the nozzles to align with the center of the pipe gap.

5. The multi-directional jet cleaning apparatus according to claim 3, wherein the second nozzle transmission mechanism comprises a fourth rotating shaft, and an auxiliary synchronous wheel, an auxiliary bearing and an auxiliary bevel gear set outside the fourth rotating shaft in order from top to bottom, with the auxiliary bearing being fixed to the lower cover, the auxiliary synchronous wheel contacting and rotating synchronously with the synchronous belt.

6. The multi-directional jet cleaning apparatus according to claim 5, wherein the second nozzle assembly comprises a rotating frame, a second nozzle bevel gear socketed on the rotating frame, a mounting frame attached to both ends of the rotating frame, and a second nozzle located on the rotating frame, with the mounting frame being rigidly mounted on the frame assembly, the second nozzle bevel gear meshing with the auxiliary bevel gear, the second flow channel being provided within the rotating frame to connect the water flow channel to the second nozzle.

7. The multi-directional jet cleaning apparatus according to claim 6, wherein a second nozzle bearing is provided between the rotating frame and the mounting frame, and a second seal ring is provided at both ends of the rotating frame; two or more second nozzles are located on the rotating frame, and the second nozzles are symmetrically located on both sides of the second nozzle bevel gear.

8. The multi-directional jet cleaning apparatus according to claim 6, wherein a main bearing is located at the upper end of the first rotating shaft, the second rotating shaft, the third rotating shaft, and the fourth rotating shaft, with the main bearing being fixed to the upper cover; a cavity is formed between the upper cover and the lower cover, and the driving synchronous wheel, driven synchronous wheel, driving spur gear, driven spur gear, and synchronous belt are accommodated in the cavity.

9. The multi-directional jet cleaning apparatus according to claim 6, wherein the water flow channel comprises a main branch section of the waterway, a first branch section connecting the main branch section of the waterway to a first flow channel, and a second branch section connecting the main branch section of the waterway to a second flow channel; and that the main branch section of the waterway is elliptical in cross-section.

10. The multi-directional jet cleaning apparatus according to claim 9, wherein the first nozzle assembly is located on one side in the extension direction of the main branch section of the waterway, and two first nozzle assemblies of each group are asymmetrically located on both sides of the main branch section of the waterway; the connections of the first branch sections corresponding to two first nozzle assemblies of each group and the main branch section of the waterway are located on either side of a short axis of the main branch section of the elliptical waterway respectively and asymmetrically located on either side of the short axis.

11. The multi-directional jet cleaning apparatus according to claim 6, wherein the transmission assembly comprises a tensioning mechanism, with the tensioning mechanism comprising a fixed seat, and a fixed shaft and an adjusting synchronous wheel fixed to the fixed seat, the adjusting synchronous wheel contacting and tensioning the synchronous belts to rotate all synchronous wheels contacting synchronous belts.

* * * * *